US012209517B1

(12) United States Patent
Schultz et al.

(10) Patent No.: US 12,209,517 B1
(45) Date of Patent: Jan. 28, 2025

(54) OIL COLLECTION DEVICE FOR USE WITH ENGINE

(71) Applicant: KAWASAKI MOTORS, LTD., Akashi (JP)

(72) Inventors: Matthew Schultz, Grand Rapids, MI (US); Brad Patera, Grand Rapids, MI (US)

(73) Assignee: KAWASAKI MOTORS, LTD., Akashi (JP)

( * ) Notice: Subject to any disclaimer, the term of this patent is extended or adjusted under 35 U.S.C. 154(b) by 0 days.

(21) Appl. No.: 18/416,667

(22) Filed: Jan. 18, 2024

(51) Int. Cl.
*F01M 11/03* (2006.01)
*F01M 11/04* (2006.01)

(52) U.S. Cl.
CPC ..... *F01M 11/0408* (2013.01); *F01M 11/03* (2013.01)

(58) Field of Classification Search
CPC . F01M 11/0408; F16N 31/002; F16N 31/006; Y10T 137/5762
USPC ..... 123/196 A
See application file for complete search history.

(56) References Cited

U.S. PATENT DOCUMENTS 5,114,354 A * 5/1992 Franks, Jr. ..... H01R 4/64 439/433
5,160,271 A * 11/1992 Franks, Jr. ..... B23K 37/0435 439/803
5,620,018 A * 4/1997 Carpenter ..... F16N 31/006 141/114
5,655,624 A * 8/1997 Kelly, Jr. ..... F16N 31/002 184/1.5
5,857,503 A * 1/1999 Vreeken ..... F16N 31/002 141/343
7,156,067 B1 * 1/2007 Gottschalk ..... B25B 27/0042 123/196 R
10,024,208 B1 7/2018 Spitz et al.
11,486,280 B2 * 11/2022 Pewett ..... F01M 11/0458
2004/0112324 A1 * 6/2004 Sitzberger ..... F01M 11/0408 123/196 R
2017/0081008 A1 * 3/2017 Hudson ..... F01M 11/0408

* cited by examiner

*Primary Examiner* — Long T Tran
*Assistant Examiner* — James J Kim
(74) *Attorney, Agent, or Firm* — Alleman Hall & Tuttle LLP

(57) ABSTRACT

An oil collection device for use with an engine having an oil filter mounting structure and an oil filter mounted thereto is provided. The oil collection device comprises a tray including a concavity that is open from above. The oil collection device further comprises a first connector formed on the tray, in which the first connector includes an attachment structure configured to removably attach to a portion of the engine below the oil filter. The oil collection device further comprises a second connector formed on the tray, in which the second connector has a drain hole formed therein, the drain hole extending through the tray and opening to the concavity, the second connector being configured to attach to a drain hose.

17 Claims, 8 Drawing Sheets

OIL COLLECTION DEVICE FOR USE WITH ENGINE

BACKGROUND

An engine oil filter is a device that mounts to a filter hole in a case of an engine, and removes contaminants from engine oil circulating in the engine during use. The oil filter traps dirt, metal shavings, and other debris that can accumulate in the oil over time. This helps to keep the engine clean and running smoothly. The oil filter needs to be replaced regularly as the filter gradually becomes clogged over time. When replacing the oil filter on an engine, oil can drip out of the oil filter and filter hole when the oil filter is separated from the engine case. The spilled oil could cause contamination to components located under the oil filter. To prevent this, an absorbent towel can be placed under the oil filter to catch the oil; however, oil soaked towels can be messy and towels are not always available. Some engines are equipped with a flat metallic shelf formed as part of the engine case below the oil filter hole to catch oil drippings. However, the size of the shelf is not sufficient to catch all the oil so oil can spill off the shelf and contaminate components in the vicinity. Increasing the size of the shelf to catch all of the oil would be problematic because of the additional size and weight that would be added to the engine case, which would decrease fuel economy and increase manufacturing and shipping costs of the engine.

SUMMARY

To address the above issues, according to one aspect of the present disclosure, an oil collection device for use with an engine having an oil filter mounting structure and an oil filter mounted thereto is provided. The oil collection device comprises a tray including a concavity that is open from above. The oil collection device further comprises a first connector formed on the tray, in which the first connector includes an attachment structure configured to removably attach to a portion of the engine below the oil filter. The oil collection device further comprises a second connector formed on the tray, in which the second connector has a drain hole formed therein, the drain hole extending through the tray and opening to the concavity, the second connector being configured to attach to a drain hose.

According to another aspect, a case assembly is provided. The case assembly includes a case having a fluid hole, an integral drip tray formed below the fluid hole, and a collection device removably attached to the integral drip tray. The collection device includes a tray including a concavity that is open from above and configured to receive fluid that drips from the fluid hole, a first connector formed on a side of the tray removably attaching the collection device to the integral drip tray of the case, a second connector formed on an other side of the tray, and a drain hose connected to the second connector.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
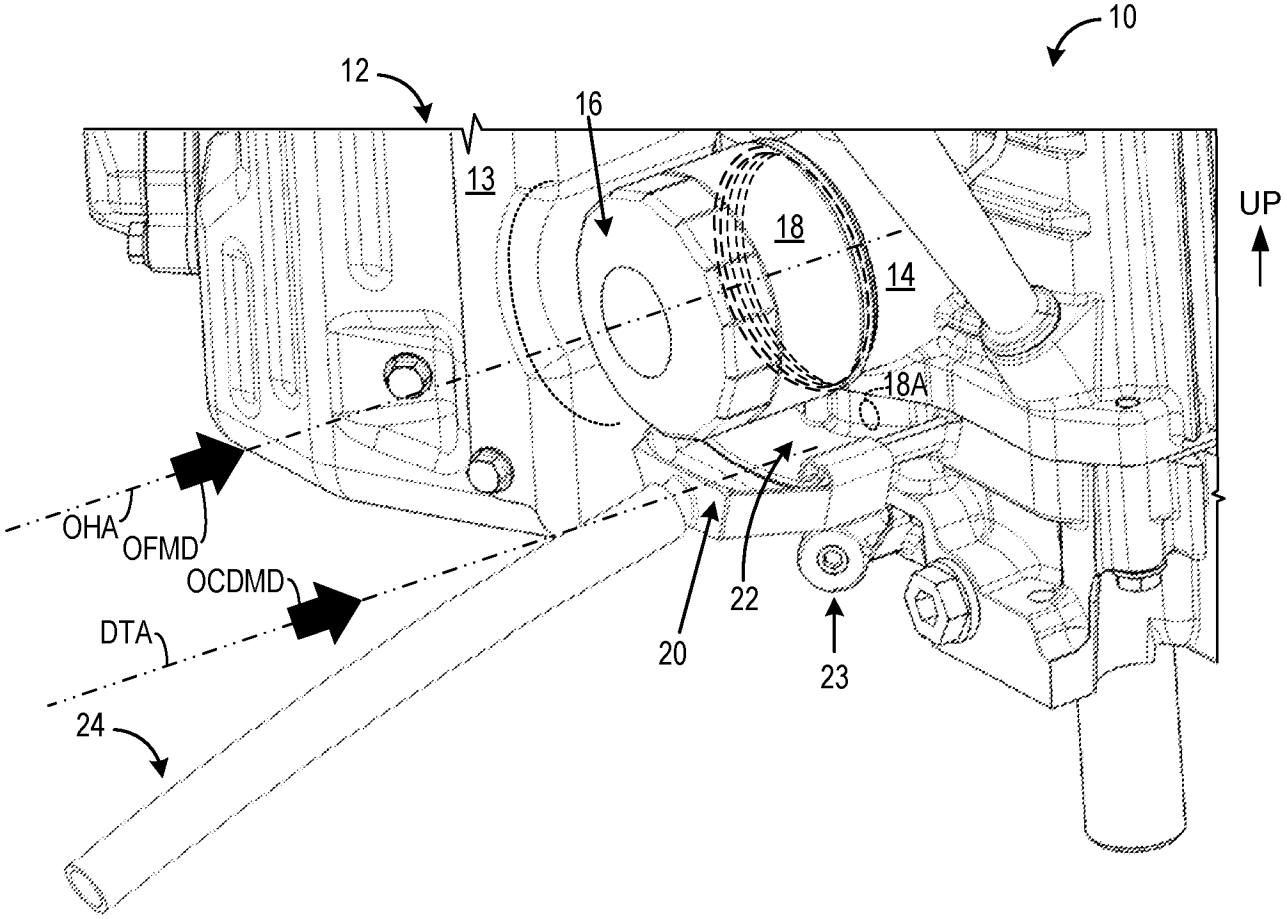
FIG. 1 is a perspective view of an engine assembly including an oil collection device.
Figure 2:
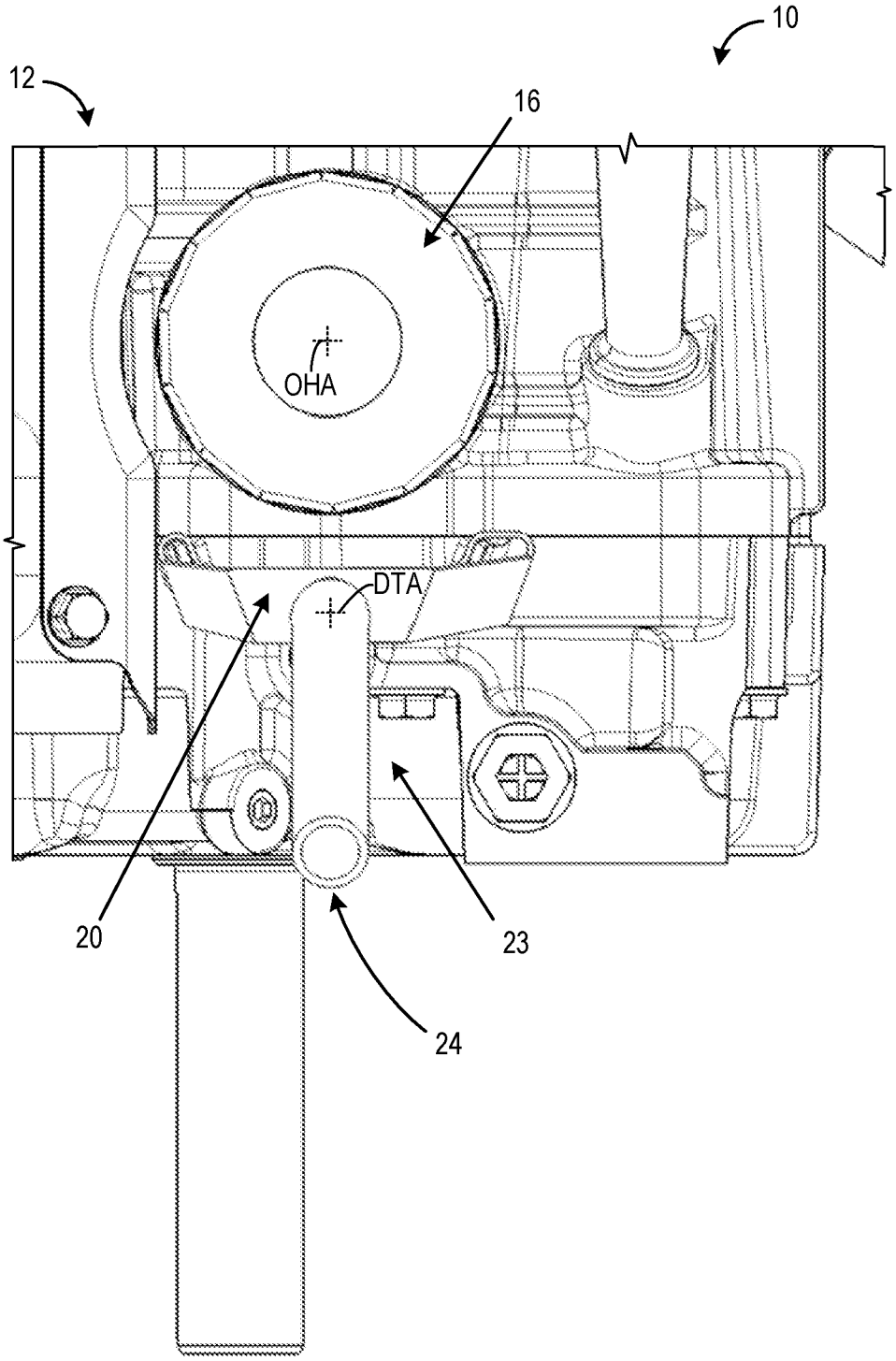
FIG. 2 is a front elevational view of the engine assembly including the oil collection device of FIG. 1.
Figure 3:
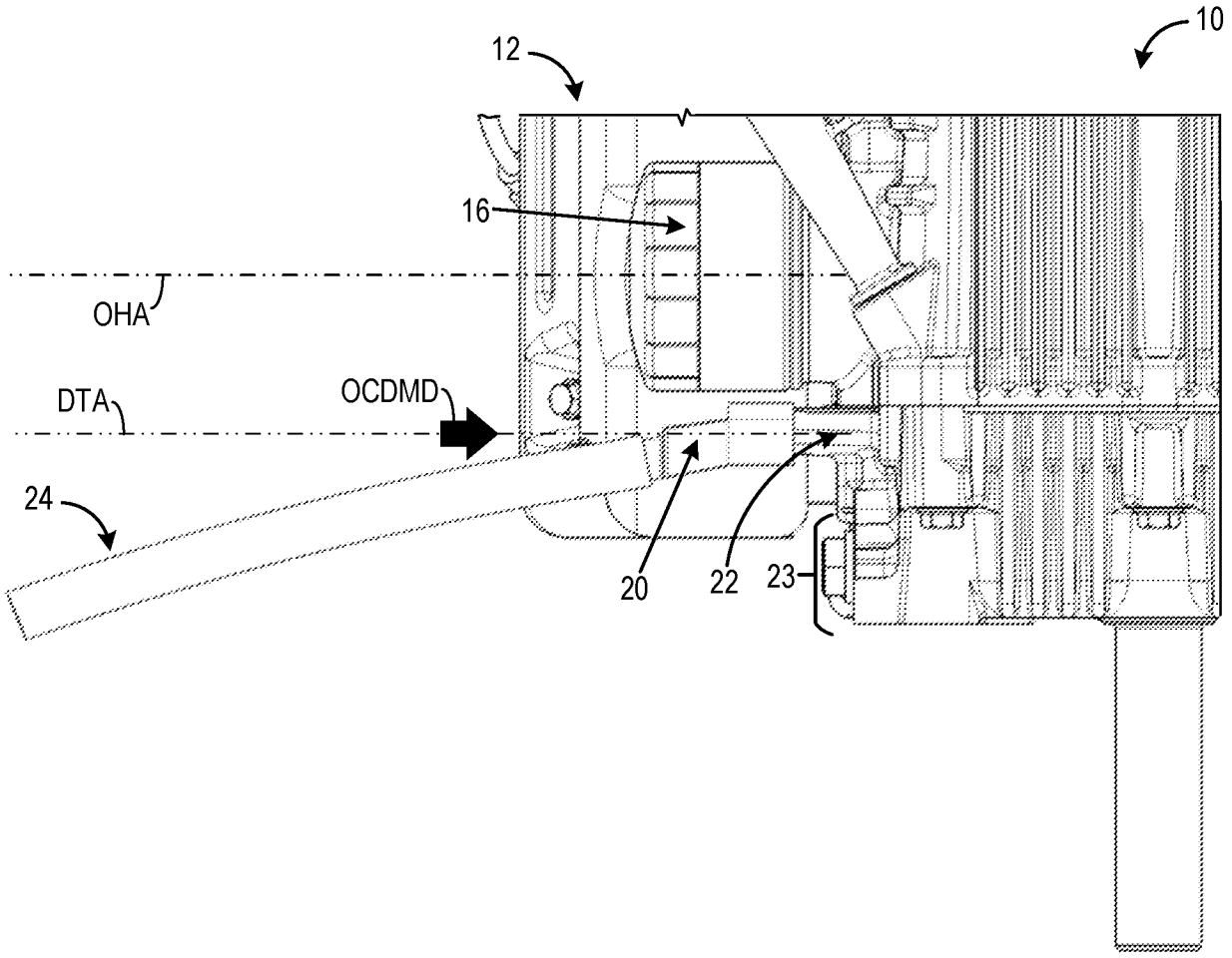
FIG. 3 is a side elevational view of the engine assembly including the oil collection device of FIG. 1.
Figure 10:
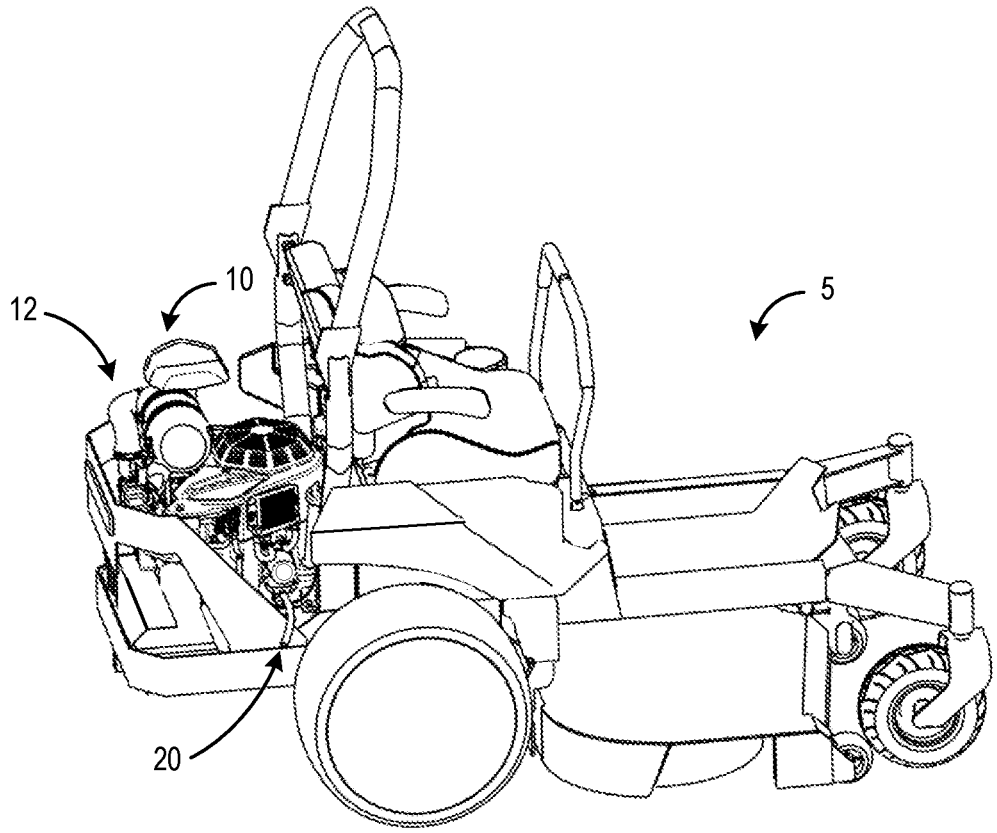
FIG. 10 is a perspective view of a vehicle including the engine assembly configured to be attached to the oil collection device of FIG. 1.
Figure 11:
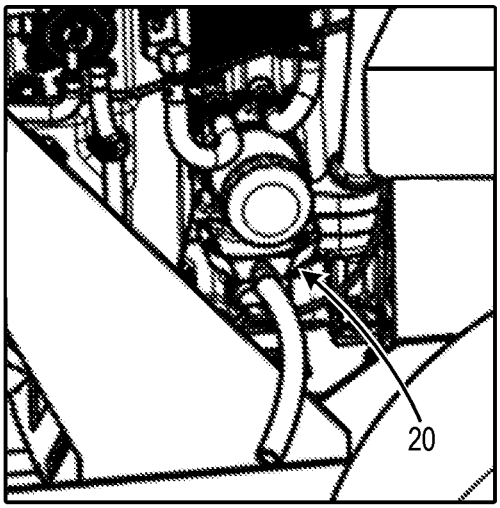
FIG. 11 is an enlarged view of the engine assembly including the oil collection device of the vehicle of FIG. 10.

To address the issues identified above, an engine assembly and an oil collection device for use therein are disclosed herein. FIGS. 1-3 illustrate a perspective view, front elevational view, and side elevational view of an engine assembly (or case assembly) 10 including an oil collection device 20. FIG. 10 is a perspective view of a vehicle 5 including the engine assembly 10 configured to be attached to the oil collection device 20, and FIG. 11 is an enlarged view of the engine assembly 10 including the oil collection device 20 of the vehicle, according to one specific example. The engine assembly 10 may be provided in a vehicle, such as a tractor, side-by-side utility vehicle, motorcycle, motor scooter, go-kart, snowmobile, or automobile. Alternatively, the engine assembly may be provided in a generator, lawn mower, concrete mixer, auger, or other industrial machine. When mounted on a vehicle, the engine assembly 10 is supported by the vehicle's frame. For the vertical direction of the engine assembly 10, the position in which the engine is fixed to a predetermined engine mount is referred to as an engine fixed position. The engine assembly 10 may also be referred to as the engine fixed position in which the oil in an engine case flows under its own weight toward an oil reservoir formed in the engine case.

As shown in FIGS. 1-3, the engine assembly (or case assembly) 10 includes an engine 12 having an engine case 13 with an oil filter mounting structure 14 formed therein. The engine is an internal combustion engine, with combustion chambers and reciprocating pistons situated within the engine case. To lubricate sliding parts such as pistons and bearings, oil circulates through engine 12. To filter the oil of debris, an oil filter 16 is provided. The oil filter mounting structure 14 includes an oil hole 18 that is internally threaded, and the oil filter 16, which is also threaded, is mounted to the mounting structure 14 by threaded engagement in the oil hole 18. Of the engine case 13, the mounting surface of the engine case 13 to which the oil filter 16 is attached includes a component extending in the vertical direction. In this embodiment, the surface on which the oil filter 16 is mounted is set to a vertically extending surface in the engine fixed position.

The engine assembly 10 may further include an integral drip tray 22 formed in the engine case 13 of the engine 12 below the oil filter mounting structure 14 and the oil hole 18.

The integral drip tray 22 is a portion of the engine case 13 shaped as a flat plate with upturned sides, which is formed during casting of engine case 13 and thus made of the same metal as the engine case 13. In the engine fixed position, the integral drip tray 22 protrudes from the wall surface where the oil filter 16 is mounted in a direction perpendicular to the vertical direction, specifically the direction in which the oil filter 16 is mounted.

In the depicted embodiment, the oil hole 18 formed in the engine case 13 is plugged with the removable oil filter 16, but it will be appreciated that the oil hole 18 may be plugged with a removable part other than the oil filter 16. For example, a bolt part that fits into a female thread around the oil hole 18, an oil hose part connected to the oil hole 18, an oil cooler, or a flow path switching valve may be used as the removable part to plug the oil hole 18. The effect of the oil collection device 20 described above can be enhanced by the fact that the removable part such as an oil filter needs to be attached and removed periodically.

While, in the depicted embodiment, the oil hole 18 is part of the oil filter mounting structure 14 to which the oil filter 16 is attached, it will be appreciated that an oil hole may be provided that is separate from the mounting structure 14, such as an oil drain hole 18A for draining oil which may be placed in a different location of the engine 12 than the oil filter mounting structure 14. Oil may drip from the oil filter mounting structure 14 or the oil hole 18, 18A onto the integral drip tray 22. The dripping oil can come from removal of oil filter 16 from the oil filter mounting structure 14 through the oil hole 18, or from removal of a closure bolt (not shown) from the oil drain hole 18A. The engine assembly 10 also includes lower components 23 under the integral drip tray 22. The integral drip tray 22 partially shields the lower components 23 from oil drips from the oil hole 18, 18A. However, the integral drip tray 22 may not always prevent oil drips effectively due to its limited size and shape. Particularly when oil drippage is excessive or prolonged, oil may reach the lower components 23 and contaminate the lower components 23.

While, in the depicted embodiment, the oil collection device 20 collects oil leakage from the oil hole 18 in the engine case 13, the oil collection device 20 can also be used to collect oil leaks from oil holes in cases other than the engine case 13, including a transmission case, an electric motor case, and a case of hydraulic mechanisms driven by hydraulic energy such as Hydraulic Static Transmission (HST). In other words, the oil collected by the oil collection device 20 may be oil for cooling or hydraulic energy transmission other than for lubrication. Furthermore, it will be appreciated that fluid other than oil such as water may be collected by the oil collection device 20.

At the engine fixed position, in the engine assembly 10, the oil collection device 20 is removably attached to a portion of the engine 12 below the oil filter 16 and oil hole 18, 18A. The portion of the engine 12 may include a protrusion of the engine 12 that projects in a mounting direction of the oil filter 16 or oil hole 18. In one example, the protrusion to which the oil collection device 20 mounts can be a part of the engine case 13 such as the integral drip tray 22. Thus, the portion of the engine 12 may further include the integral drip tray 22 such that the oil collection device 20 is removably attached to the integral drip tray 22. Alternatively, a differently shaped protrusion may be used as the portion of the engine 12 to which the oil collection device 20 is mounted. Furthermore, in this embodiment, the collection device 20 is attached to the engine assembly 10 which is mounted on the vehicle, but the collection device 20 may be attached to an engine or case that is fixed to a fixed object such as industrial equipment.

Figure 4:
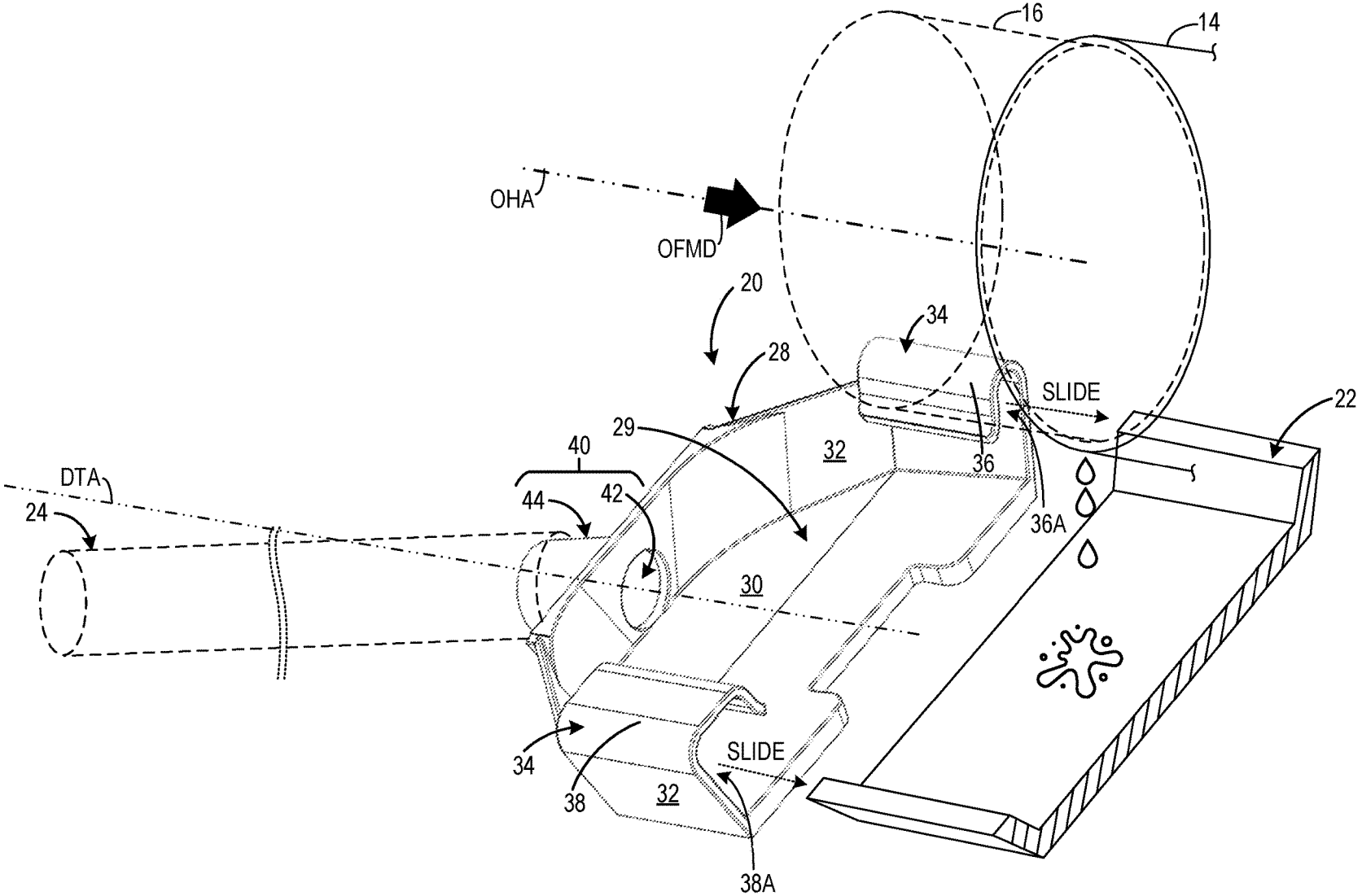
FIG. 4 is a perspective view of the oil collection device of FIG. 1.

FIG. 4 is a perspective view of the oil collection device 20. The oil collection device 20 includes a collection tray 28 including a concavity 29 that is open from above and configured to receive oil that drips from the oil filter mounting structure 14 and/or the oil hole 18, 18A. The tray 28 further includes a floor 30 on a bottom side and a perimeter sidewall 32 extending upward from the floor 30 at least partially around the concavity. The concavity of the tray 28 is open on a top side to receive oil that drains from the oil filter mounting structure 14. The floor 30 of the tray 28 is larger than a surface of the integral drip tray 22 such that the oil collection device 20 is able to receive oil that spills from the tray 28. The perimeter sidewall 32 and the floor 30 may form a funnel shape. The oil collection device 20 may be made of plastic, metal, rubber, or fiberglass.

As shown in FIG. 4, the oil collection device 20 may further include a first connector 34 formed on a side of the tray 28. The first connector 34 includes a first attachment structure 36 configured to removably attach to the portion or the integral drip tray 22 of the engine 12 below the oil filter 16 or the oil hole 18. The first connector 34 may further include a second attachment structure 38 spaced apart from the first attachment structure 36. The second attachment structure 38 may be formed on the opposite side of the first attachment structure 36, in a lateral direction perpendicular to a direction of the drain hole 42. Similar to the first attachment structure 36, the second attachment structure 38 may be configured to removably attach to the portion or the integral drip tray 22 of the engine 12 below the oil filter 16. The first attachment structure 36 and the second attachment structure 38 may be configured to be partially inserted and attached to the integral drip tray 22. The first attachment structure 36 and second attachment structure 38 may be configured to removably attach to the portion or the integral drip tray 22 in an oil collection device mounting direction OCDMD substantially parallel to an oil filter mounting direction OFMD of the oil filter 16, along an axis parallel to an oil hole axis OHA of the oil hole 18, or in the mounting direction substantially parallel to the longitudinal drip tray axis DTA of the integral drip tray 22. With this configuration, the oil collection device 20 can be easily mounted and removed using the space for mounting the oil filter 16 on the engine 12. The first attachment structure 36 and the second attachment structure 38 may be made of an elastomeric material to grip the integral drip tray 22, and these elastomeric portions can differ from the materials of other parts of the oil collection device 20.

The first attachment structure 36 and the second attachment structure 38 can be sliding attachment structures configured to removably and slidably attach to the protrusion or the integral drip tray 22 of the engine 12 by gripping the protrusion or the integral drip tray 22 of the engine 12. To achieve this sliding mountability, the first attachment structure 36 and second attachment structure 38 may include at least one of a slot or a projection that slide into the protrusion or the integral drip tray 22 of the engine 12. In the depicted embodiment, slots 36A, 38A are provided, which slide onto respective raised portions of the integral drip tray 22 that project from the engine case 13. Alternatively, it will be appreciated that the first attachment structure 36 and the second attachment structure 38 may be configured to attach to the protrusion, the integral drip tray 22, or a case wall of the engine 12 by bolting or magnetic fastening, instead of sliding.

In this embodiment, the collection device 20 is attached to engine case 13 by engaging the integrated tray 22. Alternatively, it will be appreciated that the collection device 20 may be also attached to the engine case 13 by bolting or by a fastener equipped with a spring that provides a pinching force, or it may be removably attached to the engine case 13 by a magnetic force or a suction cup structure. Furthermore, the collection device 20 may also be attached to the engine case 13 via multiple mounting structures. This allows the engine case 13 to be attached to a variety of case shapes, thereby improving versatility. Moreover, it will be appreciated that the collection device 20 may be applied to cases that do not have an integrated drip tray 22. For example, protrusions, recesses, and bolt holes formed in the engine case 13 may be used to attach the collection device 20 to the engine case 13.

The oil collection device 20 may further include a second connector 40 formed on the tray 28 where the second connector 40 has a drain hole 42 formed therein. The drain hole 42 extends through the tray 28 and opens to the concavity. A distal end of the second connector 40 is configured to attach to a drain hose 24. The drain hose 24 may be a flexible hose that can be adjusted to various configurations flexibly such that any discharge direction can be selected. The second connector 40 may have a tubular protrusion 44 projecting in a direction substantially parallel to a mounting direction MD of the oil filter 16. The tubular protrusion 44 has the drain hole 42 formed therein, extending through a sidewall 32 of the tray 28 and opening to the concavity 29. The tubular protrusion 44 is configured to attach to the drain hose 24, via an interference fit. The tray 28, the first connector 34, and the second connector 40 may be integral with each other in a single body of material, for example, injection molded plastic. With this configuration, the tubular protrusion 44 can be formed using the space for mounting the oil filter 16, which prevents interference with peripheral engine parts. It will be appreciated that the second connector 40 may be formed on the other side of the tray 28 opposite the first connector 34. Moreover, the drain hose 24 may be integrated with the oil collection device 20 or made to be removably separable, as illustrated.

Figure 5:
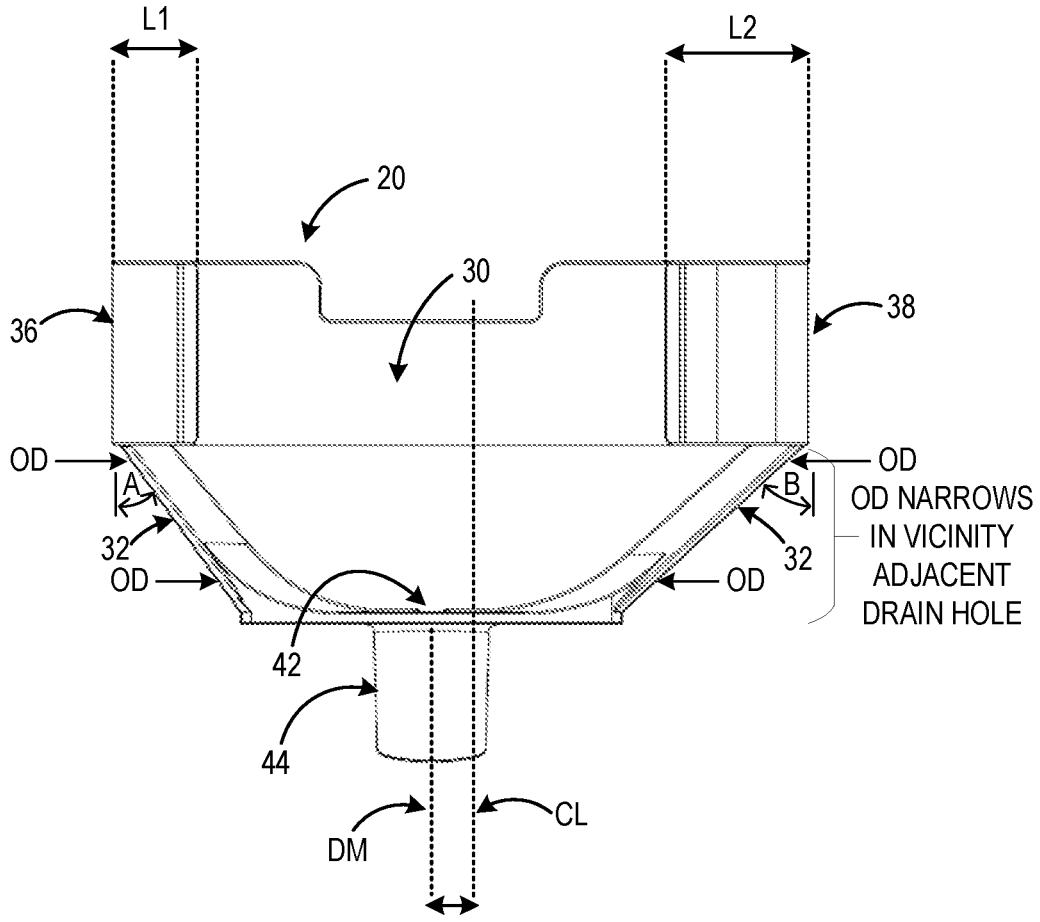
FIG. 5 is a plan view of the oil collection device of FIG. 1, as viewed from above.
Figure 8:
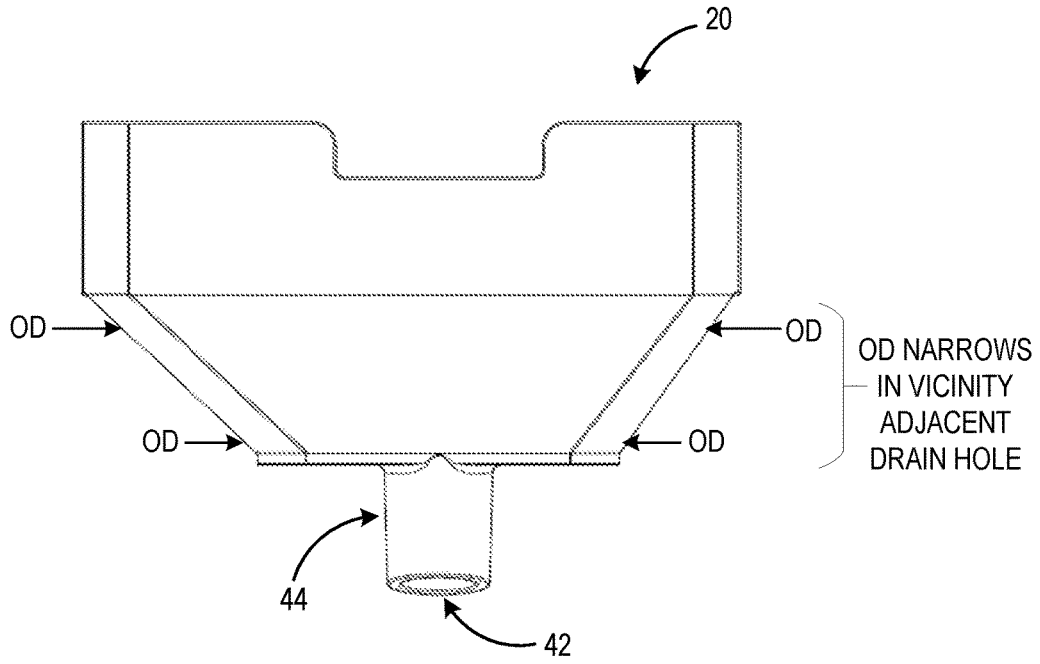
FIG. 8 is a plan view of an oil collection device of FIG. 1, as viewed from below.

FIG. 5 is a plan view of the oil collection device 20 as viewed from above. As viewed from above, an outer dimension OD of the perimeter sidewall 32 narrows in a vicinity adjacent the drain hole 42. That is, the OD of the width of the oil collection device 20 narrows toward a front of the device. This narrowing of the OD is also visible from the bottom, as shown in FIG. 8. It will be apparent from FIGS. 5 and 8 that the angles of the narrowing are asymmetric, with the angle A of narrowing on the side of the first attachment structure 36 being less than the angle B of narrowing on the side of the second attachment structure 38, to accommodate the wider width of the second attachment structure 38. Furthermore, the second attachment structure 38 of the first connector 34 may include a slot L2 that is wider than a corresponding slot L1 of the first attachment structure 36 of the first connector 34, to accommodate variances in a width of the portion or the integral drip tray 22 of the engine 12. Moreover, as shown in FIG. 5, the center axis DM of the drain hole 42 may be displaced toward the first attachment structure 36 from the centerline CL of the oil collection device 20 to accommodate a tight space around the first attachment structure 36.

Figure 6:
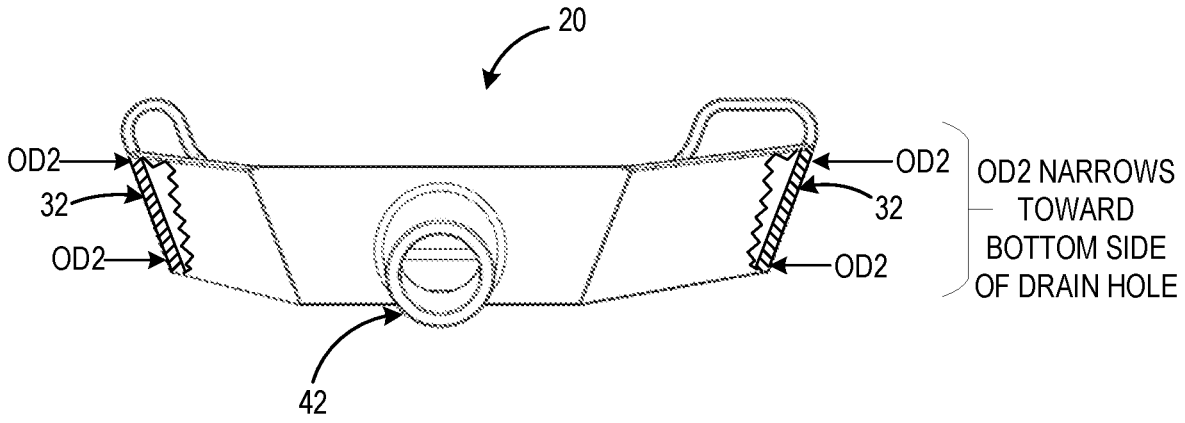
FIG. 6 is a front elevational view of the oil collection device of FIG. 1.
Figure 7:
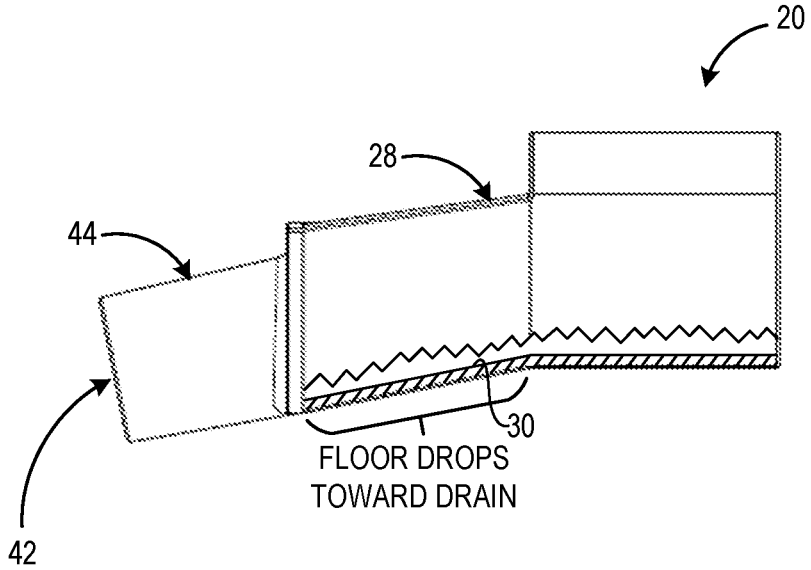
FIG. 7 is a side elevational view of the oil collection device of FIG. 1.
Figure 9:
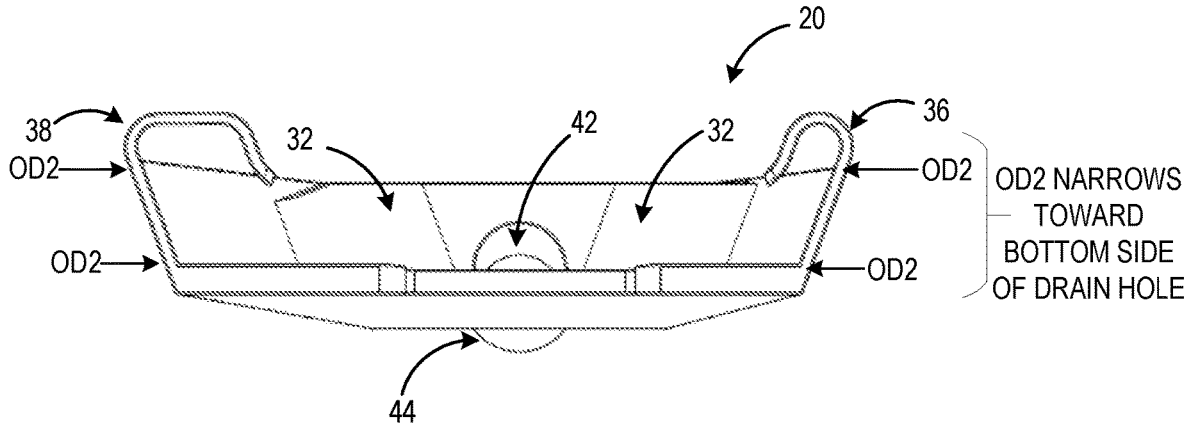
FIG. 9 is a rear view of the oil collection device of FIG. 1.

FIG. 6 is a front elevational view of the oil collection device 20. FIG. 7 is a side elevational view of the oil collection device 20. FIG. 8 is a plan view of an oil collection device as viewed from below, while FIG. 9 is a rear view of the oil collection device. As shown in FIG. 6, as viewed in cross section from the front along an axis of the drain hole 42, an outer diameter OD2 of the perimeter sidewall 32 of the tray 28 of the oil collection device 20 narrows toward a bottom side of the drain hole 42. That is, the sidewalls 32 are angled inward towards the bottom floor 30 of the oil collection device 20 in this view. The narrowing of OD2 towards the bottom floor 30 is also illustrated in FIG. 9, from the rear. In the depicted embodiment, the angle of the sidewall narrowing on each side is the same as shown in FIGS. 6 and 9, although in other embodiments an asymmetric narrowing could be used. As shown in FIG. 7, as viewed in cross section perpendicularly to an axis of the drain hole 42, the floor 30 of the tray 28 of the oil collection device 20 drops towards (i.e., in the vicinity of) a bottom side of the drain hole 42. This drop promotes drainage of oil out of the drain hole 42. Typically floor 30 is horizontal toward a rear end of the device to promote sliding engagement with the integral drip tray 22, and then the drop begins about halfway toward the front of the oil collection device 10, as shown.

The oil collection device 20 and engine assembly 10, described herein, provide an effective mechanism for collecting oil that spills from engine 12. The oil collection device 20 can be attached to a portion of the engine 12 efficiently using the open space around the oil filter 16. This design ensures that any oil that spills from the engine 12 is collected effectively, preventing contamination to other parts of the engine 12, including electrical components located below the oil filter 16. Since the oil collection device can be attached and removed easily, it does not need to remain attached to the device during shipment and use, for example, saving weight and space. The sliding engagement enables the device to be quickly attached without the use of specialized tools, promoting ease of use.

The following paragraphs provide additional description of the subject matter of the present disclosure. One aspect provides an oil collection device for use with an engine having an oil filter mounting structure and an oil filter mounted thereto. According to this aspect, the oil collection device may include a tray including a concavity that is open from above. The oil collection device may further include a first connector formed on the tray, in which the first connector may include an attachment structure configured to removably attach to a portion of the engine below the oil filter. The oil collection device may further include a second connector formed on the tray, in which the second connector may have a drain hole formed therein. The drain hole may extend through the tray and open to the concavity, in which the second connector may be configured to attach to a drain hose.

According to this aspect, the tray may include a floor on a bottom side and a perimeter sidewall extending upward from the floor at least partially around the concavity, in which the concavity of the tray may be open on a top side to receive oil that drains from the oil filter mounting structure.

According to this aspect, as viewed from above, an outer dimension of the perimeter sidewall may narrow in a vicinity adjacent the drain hole.

According to this aspect, as viewed in cross section along an axis of the drain hole, an outer diameter of the perimeter sidewall may narrow toward a bottom side of the drain hole.

According to this aspect, as viewed in cross section perpendicularly to an axis of the drain hole, the floor may drop towards a bottom side of the drain hole.

According to this aspect, he perimeter sidewall and the floor may form a funnel shape.

According to this aspect, the tray, the first connector, and the second connector may be integral with each other in a single body of material.

According to this aspect, the attachment structure may be a first attachment structure. The first connector may further include a second attachment structure spaced apart from the first attachment structure, in which the second attachment structure may be configured to removably attach to the portion of the engine below the oil filter.

According to this aspect, the second attachment structure may include a slot that is wider than a corresponding slot of the first attachment structure, to accommodate variances in a width of the portion of the engine.

According to this aspect, the attachment structure of the first connector may be configured to removably attach to the portion of the engine below the oil filter in a mounting direction substantially parallel to a mounting direction of the oil filter.

According to this aspect, the second connector may have a tubular protrusion projecting in a direction substantially parallel to a mounting direction of the oil filter.

According to this aspect, the attachment structure of the first connector may be a sliding attachment structure configured to removably and slidably attach to a protrusion of the engine that projects in a mounting direction of the oil filter.

According to this aspect, the attachment structure of the first connector may be configured to attach to a protrusion of the engine that projects in a mounting direction of the oil filter by gripping the protrusion of the engine.

According to another aspect of the present disclosure, a case assembly is provided. According to this aspect, the case assembly may include a case having a fluid hole, an integral drip tray formed below the fluid hole, and a collection device removably attached to the integral drip tray. The collection device may include a tray including a concavity that is open from above and configured to receive fluid that drips from the fluid hole. The collection device may further include a first connector formed on a side of the tray removably attaching the collection device to the integral drip tray of the case. The collection device may further include a second connector formed on an other side of the tray. The collection device may further include a drain hose connected to the second connector.

According to this aspect, the first connector may include a first attachment structure configured to removably attach to the integral drip tray of the case along an axis parallel to an axis of the fluid hole, in which the first attachment structure may include at least one of a slot or a projection.

According to this aspect, the second connector may have a tubular protrusion with a drain hole formed therein, in which the drain hole may extend through the tray and open to the concavity, and the tubular protrusion may be configured to attach to the drain hose.

According to this aspect, a floor of the tray may be larger than the integral drip tray.

According to this aspect, the first connector may include a first attachment structure configured to removably attach to the integral drip tray in a mounting direction substantially parallel to a longitudinal axis of the integral drip tray. The first connector may further include a second attachment structure spaced apart from the first attachment structure. The second attachment structure may be configured to attach to the integral drip tray in the mounting direction substantially parallel to the longitudinal axis of the integral drip tray.

According to this aspect, the first attachment structure may be configured to be partially inserted and attached to the integral drip tray.

According to this aspect, the drain hose may be a flexible hose.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. An oil collection device for use with an engine having an oil filter mounting structure and an oil filter mounted thereto, the oil collection device comprising:

a tray including a concavity that is open from above;

a first connector formed on the tray, the first connector including an attachment structure configured to removably attach to a protrusion of the engine below the oil filter in an oil collection device mounting direction; and a second connector having a tubular protrusion formed on the tray, wherein the second connector has a drain hole formed therein, the drain hole extending through the tray and tubular protrusion and opening to the concavity, the tubular protrusion of the second connector being configured to attach to a drain hose, the tubular protrusion protrudes in a direction substantially parallel to the oil collection device mounting direction, the attachment structure of the first connector is a sliding attachment structure configured to removably and slidably attach to the protrusion of the engine that projects in a mounting direction of the oil filter and has a raised portion on an edge, and the attachment structure of the first connector comprises a slot that slides onto the raised portion of the protrusion of the engine.

2. The oil collection device of claim 1, wherein the tray includes a floor on a bottom side and a perimeter sidewall extending upward from the floor at least partially around the concavity, the concavity of the tray being open on a top side to receive oil that drains from the oil filter mounting structure, and the tubular protrusion protrudes in a same direction as the tray is attached to the protrusion of the engine.

3. The oil collection device of claim 2, wherein, as viewed from above, an outer dimension of the perimeter sidewall narrows in a vicinity adjacent the drain hole.

4. The oil collection device of claim 2, wherein, as viewed in cross section along an axis of the drain hole, an outer diameter of the perimeter sidewall narrows toward a bottom side of the drain hole.

5. The oil collection device of claim 2, wherein, as viewed in cross section perpendicularly to an axis of the drain hole, the floor drops towards a bottom side of the drain hole.

6. The oil collection device of claim 1, wherein the tray, the first connector, and the second connector are integral with each other in a single body of material.

7. The oil collection device of claim 1, wherein the attachment structure is a first attachment structure, the slot is a first slot of the first attachment structure, the first connector further includes a second attachment structure spaced apart from the first attachment structure, the second attachment structure being configured to removably and slidably attach to the protrusion of the engine below the oil filter, and the tubular protrusion protrudes in a direction substantially parallel to the mounting direction of the oil filter.

8. The oil collection device of claim 7, wherein the second attachment structure includes a second slot that is wider than the first slot of the first attachment structure, to accommodate variances in a width of the protrusion of the engine.

9. The oil collection device of claim 1, wherein the tubular protrusion protrudes in a direction substantially parallel to the mounting direction of the oil filter.

10. The oil collection device of claim 1, wherein the attachment structure of the first connector is configured to attach to the protrusion of the engine by gripping the protrusion of the engine.

11. A case assembly, comprising:

a case having a fluid hole;

an integral drip tray formed below the fluid hole; and a collection device removably attached to the integral drip tray, the collection device including:

a tray including a concavity that is open from above and configured to receive fluid that drips from the fluid hole;

a first connector formed on a side of the tray removably attaching the collection device to the integral drip tray of the case;

a second connector formed on an other side of the tray; and a drain hose connected to the second connector, wherein the drain hose protrudes in a same direction as a collection device mounting direction in which the collection device is attached to the integral drip tray, the attachment structure of the first connector is a sliding attachment structure configured to removably and slidably attach to the integral drip tray that projects in the collection device mounting direction and has a raised portion on an edge, and the attachment structure of the first connector comprises a slot that slides onto the raised portion of the integral drip tray.

12. The case assembly of claim 11, wherein the attachment structure of the first connector is configured to removably attach to the integral drip tray of the case along an axis parallel to an axis of the fluid hole.

13. The case assembly of claim 11, wherein the second connector has a tubular protrusion with a drain hole formed therein, the drain hole extending through the tray and opening to the concavity, the tubular protrusion being configured to attach to the drain hose.

14. The case assembly of claim 11, wherein a floor of the tray is larger than the integral drip tray.

15. The case assembly of claim 11, wherein the attachment structure is a first attachment structure, the first attachment structure of the first connector is configured to removably attach to the integral drip tray in a mounting direction substantially parallel to a longitudinal axis of the integral drip tray, and the first connector further includes a second attachment structure spaced apart from the first attachment structure, the second attachment structure being configured to removably and slidably attach to the integral drip tray in the mounting direction substantially parallel to the longitudinal axis of the integral drip tray.

16. The oil collection device of claim 1, wherein the tubular protrusion passes through a sidewall part on an opposite side of the first connector.

17. An oil collection device for use with an engine having an oil filter mounting structure and an oil filter mounted thereto, the oil collection device comprising:

a tray including a concavity that is open from above;

a first connector formed on the tray, the first connector including an attachment structure configured to removably attach to a protrusion of the engine below the oil filter; and a second connector having a tubular protrusion formed on the tray, wherein the second connector has a drain hole formed therein, the drain hole extending through the tray and opening to the concavity, the tubular protrusion of the second connector being configured to attach to a drain hose, the tubular protrusion protrudes in a mounting direction of the oil filter, the attachment structure of the first connector is a sliding attachment structure configured to removably and slidably attach to the protrusion of the engine that projects in the mounting direction of the oil filter and has a raised portion on an edge, and the attachment structure of the first connector comprises a slot that slides onto the raised portion of the protrusion of the engine.

* * * * *